US010384920B2

(12) United States Patent
Henriquez

(10) Patent No.: US 10,384,920 B2
(45) Date of Patent: Aug. 20, 2019

(54) PORTABLE SPIRIT DISPENSER

(71) Applicant: Raoul Henriquez, Oranjestad (AW)

(72) Inventor: Raoul Henriquez, Oranjestad (AW)

( * ) Notice: Subject to any disclaimer, the term of this patent is extended or adjusted under 35 U.S.C. 154(b) by 90 days.

(21) Appl. No.: 15/355,627

(22) Filed: Nov. 18, 2016

(65) Prior Publication Data

US 2017/0203946 A1 Jul. 20, 2017
US 2017/0327367 A9 Nov. 16, 2017

Related U.S. Application Data

(60) Provisional application No. 62/279,196, filed on Jan. 15, 2016.

(30) Foreign Application Priority Data

Mar. 30, 2016 (AW) ..... OCT-02/160330

(51) Int. Cl.
*B67D 1/00* (2006.01)
*B67D 1/10* (2006.01)
*B67D 1/08* (2006.01)

(52) U.S. Cl.
CPC ..... *B67D 1/0007* (2013.01); *B67D 1/001* (2013.01); *B67D 1/0004* (2013.01); *B67D 1/0005* (2013.01); *B67D 1/0829* (2013.01); *B67D 1/0892* (2013.01); *B67D 1/10* (2013.01); *B67D 1/0888* (2013.01); *B67D 2001/0097* (2013.01); *B67D 2001/0827* (2013.01); *B67D 2210/00031* (2013.01); *B67D 2210/00041* (2013.01); *B67D 2210/00049* (2013.01); *B67D 2210/00062* (2013.01); *B67D 2210/00133* (2013.01)

(58) Field of Classification Search
CPC .. B67D 1/0007; B67D 1/0005; B67D 1/0004; B67D 1/0892; B67D 1/0829; B67D 1/001; B67D 1/10; B67D 2210/00041; B67D 2210/00031; B67D 2001/0097; B67D 2210/00133; B67D 2210/00062; B67D 2210/00049; B67D 2001/0827; B67D 1/0888
USPC ..... 222/129.1
See application file for complete search history.

(56) References Cited

U.S. PATENT DOCUMENTS 3,331,536 A 7/1967 Lorenzo
3,845,787 A 11/1974 Slagle
3,933,275 A 1/1976 Metzner et al.
3,940,019 A 2/1976 Kross et al.
(Continued)

FOREIGN PATENT DOCUMENTS

CN 201825720 5/2011
GB 2 227 824 8/1990
(Continued)

*Primary Examiner* — Donnell A Long
(74) *Attorney, Agent, or Firm* — Ostrolenk Faber LLP

(57) ABSTRACT

A spirit dispenser that includes a cabinet that includes a back panel facing an interior of the cabinet, and a plurality of shelves, each shelf being able to support thereon a plurality of spirit containers; at least one spirit dispenser system integrated with the cabinet; and a plurality of pumps residing on an interior surface of the pack panel of the cabinet, each pump being connected to a first tube that includes a tap connector configured for connection to a tap of a spirit container supportable on one of the shelves of the cabinet, and a second tube that is connected to the spirit dispenser.

14 Claims, 19 Drawing Sheets

(56) References Cited

U.S. PATENT DOCUMENTS

| | | | |
|---|---|---|---|
| 3,993,218 | A | 11/1976 | Reichenberger |
| 4,027,783 | A | 6/1977 | Branch et al. |
| 4,120,425 | A | 10/1978 | Bethurum |
| 4,276,999 | A | 7/1981 | Reichenberger |
| 4,304,341 | A | 12/1981 | Shirley |
| 4,433,795 | A | 2/1984 | Maiefski |
| 4,462,220 | A | 7/1984 | Ianelli |
| 4,518,104 | A | 5/1985 | Iannelli et al. |
| 4,691,842 | A | 9/1987 | Foures |
| 4,702,396 | A | 10/1987 | Gwiazda |
| 4,706,847 | A | 11/1987 | Sankey et al. |
| 4,901,887 | A | 2/1990 | Burton |
| 4,932,561 | A | 6/1990 | Boxall |
| 5,000,351 | A | 3/1991 | Rudick |
| 5,031,799 | A | 7/1991 | Owen |
| 5,251,790 | A | 10/1993 | Cohn et al. |
| 5,379,916 | A | 1/1995 | Martindale et al. |
| 5,381,926 | A | 1/1995 | Credle, Jr. et al. |
| 5,791,517 | A | 8/1998 | Avital |
| 5,953,923 | A | 9/1999 | Davies |
| 6,010,043 | A | 1/2000 | Williamson et al. |
| 6,422,422 | B1 | 7/2002 | Forbes |
| 6,481,238 | B1 | 11/2002 | Jennings et al. |
| 7,022,283 | B2 | 4/2006 | McGuire et al. |
| 7,076,966 | B2 | 7/2006 | Mullen |
| 7,147,134 | B2 | 12/2006 | Gutierrez et al. |
| 7,156,259 | B2 | 1/2007 | Bethuy et al. |
| 7,464,567 | B1 | 12/2008 | Crossley et al. |
| 7,555,980 | B2 | 7/2009 | Howard et al. |
| 7,577,498 | B2 | 8/2009 | Jennings et al. |
| 7,712,631 | B2 | 5/2010 | Taradalsky et al. |
| 7,762,431 | B1 | 7/2010 | Tuyls et al. |
| 7,823,411 | B2 | 11/2010 | Gagliano et al. |
| 8,333,302 | B2 | 12/2012 | Fukunaga |
| 8,459,503 | B2 | 6/2013 | Groesbeck |
| 8,479,955 | B2 | 7/2013 | Vesborg et al. |
| 8,505,318 | B2 | 8/2013 | Wittern, Jr. et al. |
| 8,584,716 | B2 | 11/2013 | Bertucci et al. |
| 8,584,900 | B2 | 11/2013 | Metropulos et al. |
| 8,800,814 | B2 | 8/2014 | Braun et al. |
| 8,820,094 | B1 | 9/2014 | Casher et al. |
| 8,857,666 | B2 | 10/2014 | O'Keefe, Jr. |
| 9,090,449 | B2 | 7/2015 | Crisp, III |
| 9,102,508 | B2 | 8/2015 | O'Keefe, Jr. et al. |
| 9,146,054 | B2 | 9/2015 | Moezidis et al. |
| 2007/0214055 | A1 | 9/2007 | Temko |
| 2008/0251536 | A1 | 10/2008 | Wong |
| 2009/0014466 | A1 | 1/2009 | Saveliev et al. |
| 2009/0078721 | A1 | 3/2009 | Hoffman et al. |
| 2009/0211054 | A1* | 8/2009 | Frame ..... A47C 19/024 16/45 |
| 2010/0084426 | A1 | 4/2010 | Devers et al. |
| 2010/0132831 | A1 | 6/2010 | Waroux et al. |
| 2010/0199709 | A1 | 8/2010 | Holland et al. |
| 2011/0000250 | A1 | 1/2011 | Sommerfield et al. |
| 2011/0017776 | A1* | 1/2011 | Metropulos ..... B67D 1/0041 222/129.1 |
| 2011/0204093 | A1 | 8/2011 | Lee |
| 2011/0253746 | A1* | 10/2011 | O'Keefe, Jr. ..... B67D 1/0005 222/132 |
| 2013/0140778 | A1* | 6/2013 | Stauff ..... B62B 3/1476 280/33.996 |
| 2013/0277394 | A1* | 10/2013 | Edwards ..... B67D 1/0891 222/144.5 |
| 2014/0097201 | A1* | 4/2014 | Otto ..... B67D 3/00 222/95 |
| 2014/0103549 | A1 | 4/2014 | Staneland |
| 2014/0166694 | A1 | 6/2014 | Otto |
| 2014/0263397 | A1* | 9/2014 | Jacobs ..... B67D 1/1252 222/1 |
| 2016/0109175 | A1* | 4/2016 | Mackey ..... F25D 31/006 62/3.64 |
| 2016/0159633 | A1* | 6/2016 | Diffenderfer ..... B67D 3/0006 222/23 |

FOREIGN PATENT DOCUMENTS

| | | |
|---|---|---|
| JP | 2006-27724 | 2/2006 |
| WO | WO 94/03780 | 2/1994 |
| WO | WO 96/27552 | 9/1996 |
| WO | WO 2015/035471 | 3/2015 |

* cited by examiner

Side Elevation

Backwall Pockets

*Backside and Inside*

Back Panel:

Solid 1" Doors:
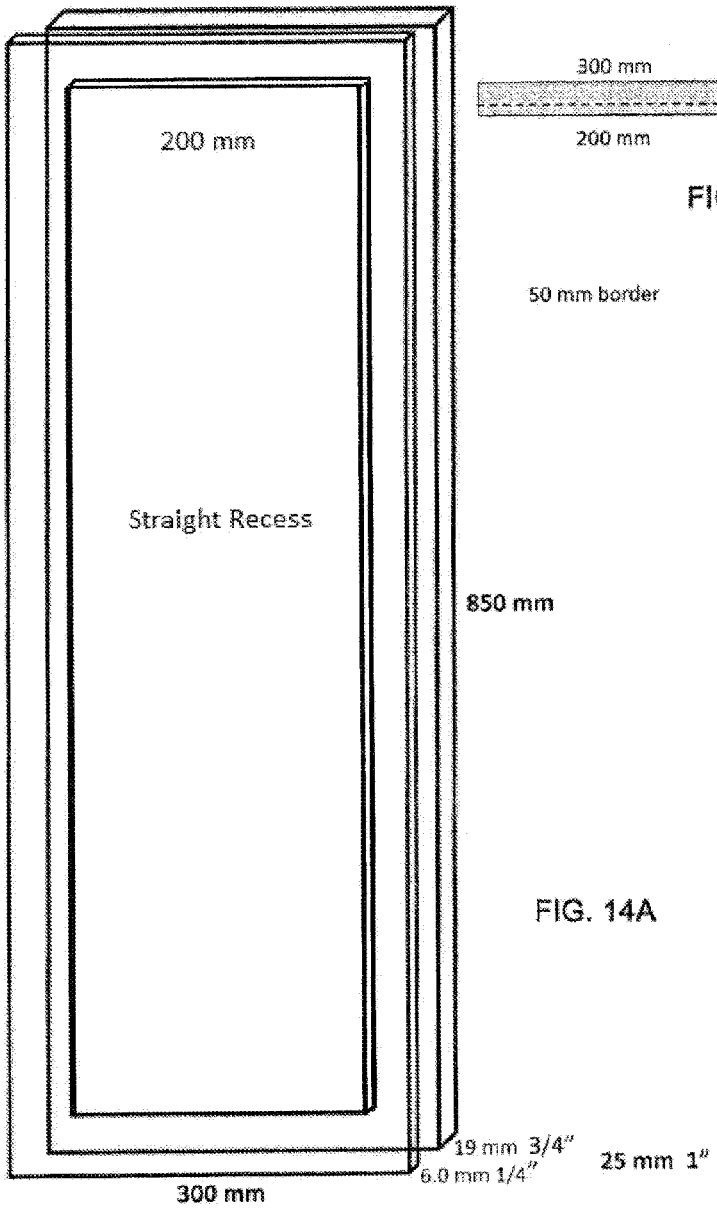
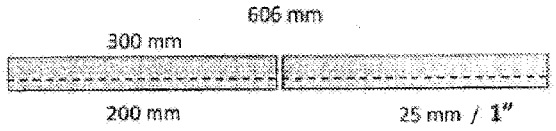
FIG. 14B
50 mm border
FIG. 14A

Top Shelf:

Interior Shelf:

PORTABLE SPIRIT DISPENSER

CROSS-REFERENCE TO RELATED APPLICATION

The present application claims priority to U.S. Provisional Application Ser. No. 62/279,196, filed Jan. 15, 2016, the entire disclosure of which is incorporated by reference herein.

FIELD OF INVENTION

The apparatus and the method disclosed herein relate to serving of spirits and in particular to portable spirit dispensers and a method of dispensing spirits from a portable dispenser.

BACKGROUND

It is well-known that spirits may be served from a bottle at, for example, a bar or a restaurant. This method lacks security and precise accountability as it leaves the bottles with the spirits accessible to not only the bartender but to others. In a large-scale setting such as a cruise ship or a resort more security and accountability is desired to prevent losses due, for example, to pilfering, or imprecise and irregular serving practices by the staff.

Automated spirit delivery systems have been proposed.

A well-known automated spirit delivery system for serving spirits includes a storage room that stores spirits in individual bottles. In this system, each bottle stored in the storage room is connected via a fluid line to a dispenser located, for example, at a bartender's station elsewhere. A pump or the like supplies the spirit to a dispenser located at a bar or bartender's station. The dispenser may be equipped with a device that controls the amount (shots) of spirit that is poured. The system may also be equipped with a device that tracks the amount of spirit poured.

Since the storage room can be secured and the supply of spirit can be controlled this system is desirable for settings such as resorts, hotels and cruise ships. However, this system has a number of drawbacks. Significantly, the system is not portable from one location to another location in that the storage room, which is integral to the operation of the system, cannot be moved. Thus, this system cannot, for example, be used when the location of the event needing service is not near the bar or the bartender's station that is connected to the storage room. In addition, the storage room in such a system is often large in order to accommodate the large number of bottles needed to provide service to the patrons. In relatively small places such as cruise ships, such a system presents problems. For example, the storage room would occupy much needed space.

Furthermore, the empty spirit bottles would have to be stored somewhere, which is yet another problem for a cruise ship in particular.

Moreover, spirit bottles whether filled with spirits or empty are valuable, which means some security would have to be provided for the spirits in the bottle and the empty bottles to prevent pilfering.

In addition, the distance between the storage room and the point of delivery of the spirit (the bar or the bartender's station) is long, which means that a lot of spirit is stored in the lines from the storage room to the point of delivery. It is needless to say that in this configuration much of the stock of spirit always remains in the fluid lines, which means that a significant volume of stock must be invested merely to render the system operational. When the system is serviced, the spirit in the lines must be emptied out and discarded, which clearly leads to a significant loss of product. Thus, when the lines are in need of disinfecting (which is relatively often), much product is discarded and then replaced with an equivalent replacement volume. Naturally, one can easily see that the maintenance of such a system is costly.

SUMMARY

In view the mentioned problems, there is a need for a secure, efficient and portable apparatus that can be used for serving spirits.

An objective of the present invention is to provide a spirit dispenser that stores the spirit in a container other than a bottle to reduce the problems associated with systems that rely on bottle-stored spirits.

Another objective of the present invention is to provide a secure dispenser to reduce the likelihood of pilfering of the spirits.

Another objective of the present invention is to provide a portable apparatus that can dispense different kinds of spirits.

Another objective of the present invention is to provide an apparatus that can store and supply different types of spirits for a large crowd, which does not occupy a large foot print or a large volume of space.

Another objective of the present invention is to shorten the fluid line from the spirit container to the point of delivery.

Another objective of the present invention is to provide a portable spirit dispenser that can be moved from one location to another.

BRIEF DESCRIPTION OF THE FIGURES

FIGS. 14A and 14B front and tope views of the doors for a cabinet in a dispenser according to the present invention.

DETAILED DESCRIPTION

Spirit or liquor as used herein means a distilled or spirituous alcoholic beverage as distinguished from a fermented alcoholic beverage such as wine or beer.

Figure 1:
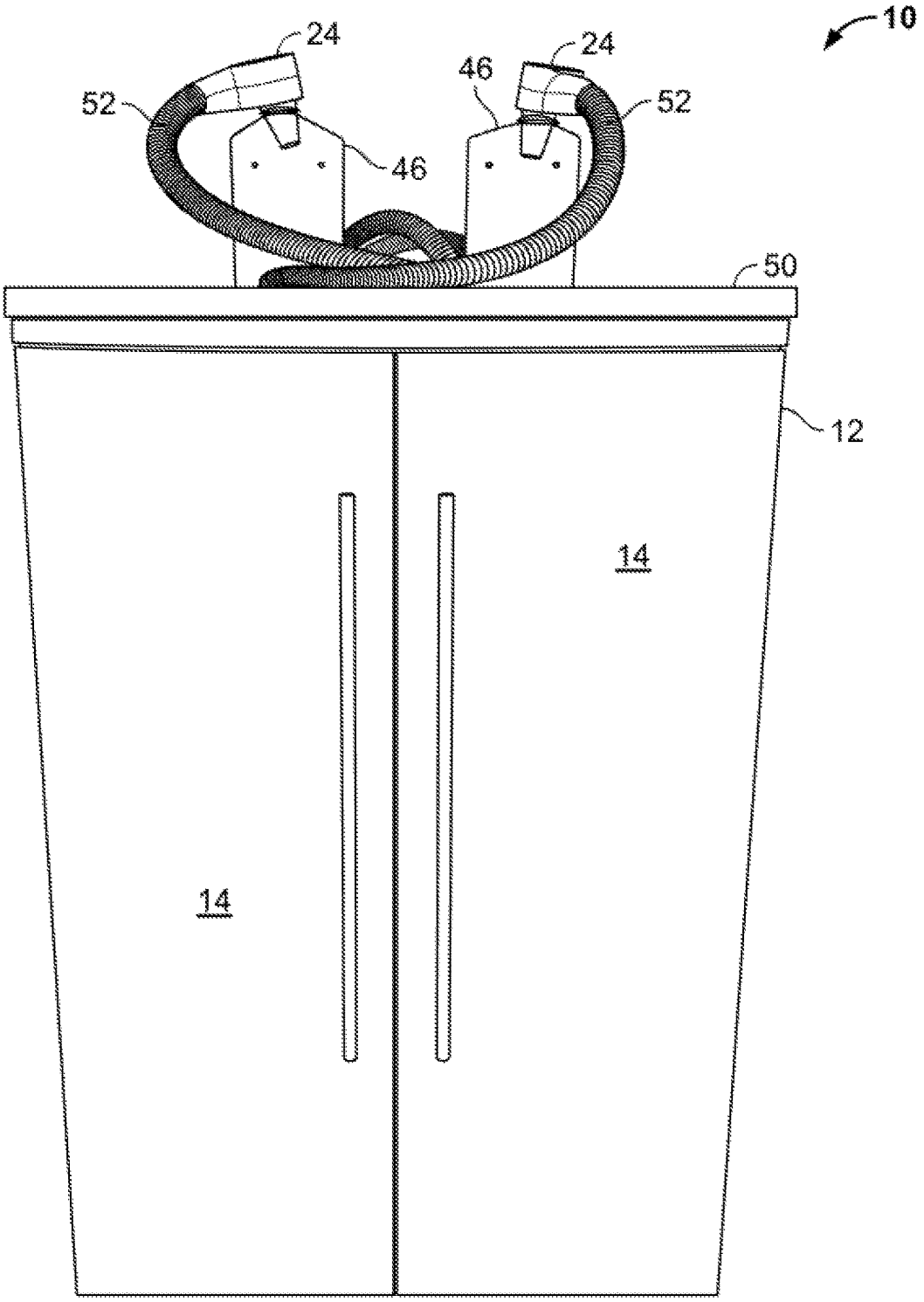
FIG. 1 shows a front view of a dispenser according to the present invention with the doors of its cabinet closed.

Referring to FIG. 1, the present disclosure is concerned with a portable spirit dispenser 10. Portable dispenser 10 includes a cabinet 12.

Figure 2:
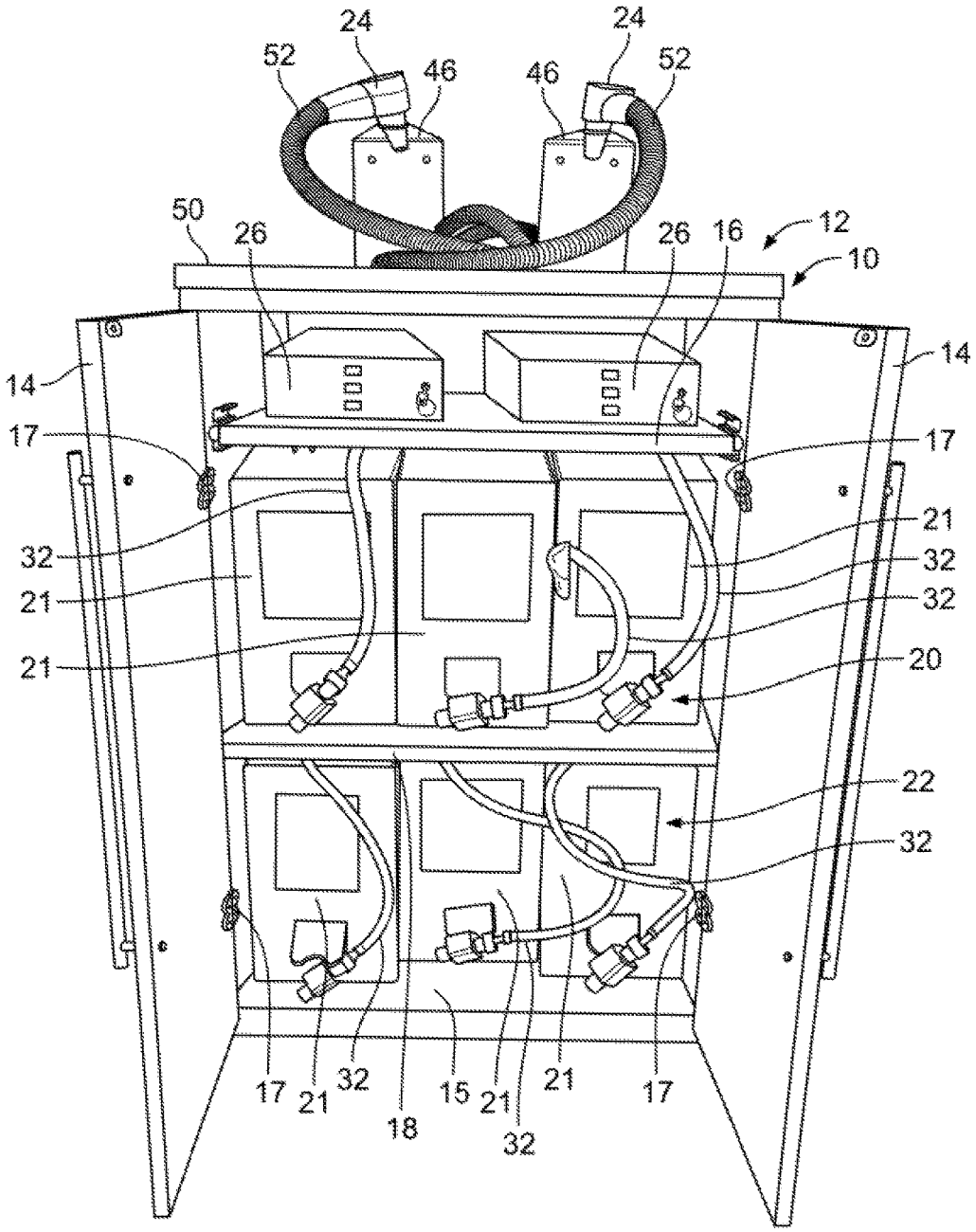
FIG. 2 shows another front view of a dispenser according to the present invention with the doors of its cabinet open.

Referring to FIG. 2, cabinet 12 preferably includes two doors 14 with hidden hinges 17 (hinges disposed interiorly of the cabinet). Doors 14 may be secured with a lock to prevent access to the interior of the cabinet. The hidden hinges 17 also prevent access to the interior of cabinet 12.

Figure 3:
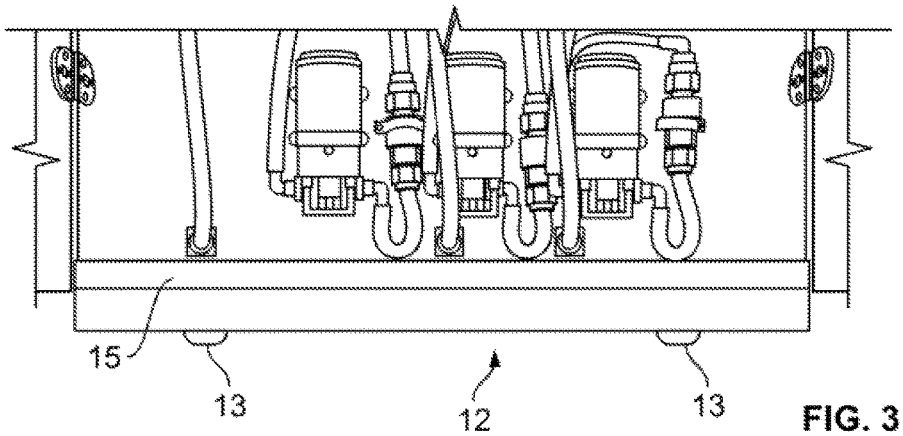
FIG. 3 shows a portion of the bottom of the cabinet of a dispenser according to the present invention.

Referring to FIG. 3, cabinet 12 includes a plurality of casters 13 (for example, four casters) connected to its base panel 15, whereby dispenser 10 may be easily pushed or pulled from one place to another without the need for, for example, a motorized vehicle to transport dispenser 10. Thus, preferably, dispenser 10 when storing spirits (fully loaded) will not weigh more than 400 pounds, which is considerably less than the weight that can be a) supported by casters 13 (e.g. 800 pounds) without suffering failure when stationary, b) transported without suffering failure while supported by casters 13.

It has been found that a swivel caster with a polyurethane wheel with a maximum load capacity of 220 pounds and a wheel diameter of 35 mm works well for a caster 13. An example of such a caster is a Blickle caster, a description of which is included in the Appendix. The polyurethane wheel produces less noise, and, while robust, it does not cause damage to, for example, tile, stone, or wood flooring. Thus, an apparatus according to the invention can be safely transported over unprotected, hard surfaces, without causing damage to the surface.

Figure 4:
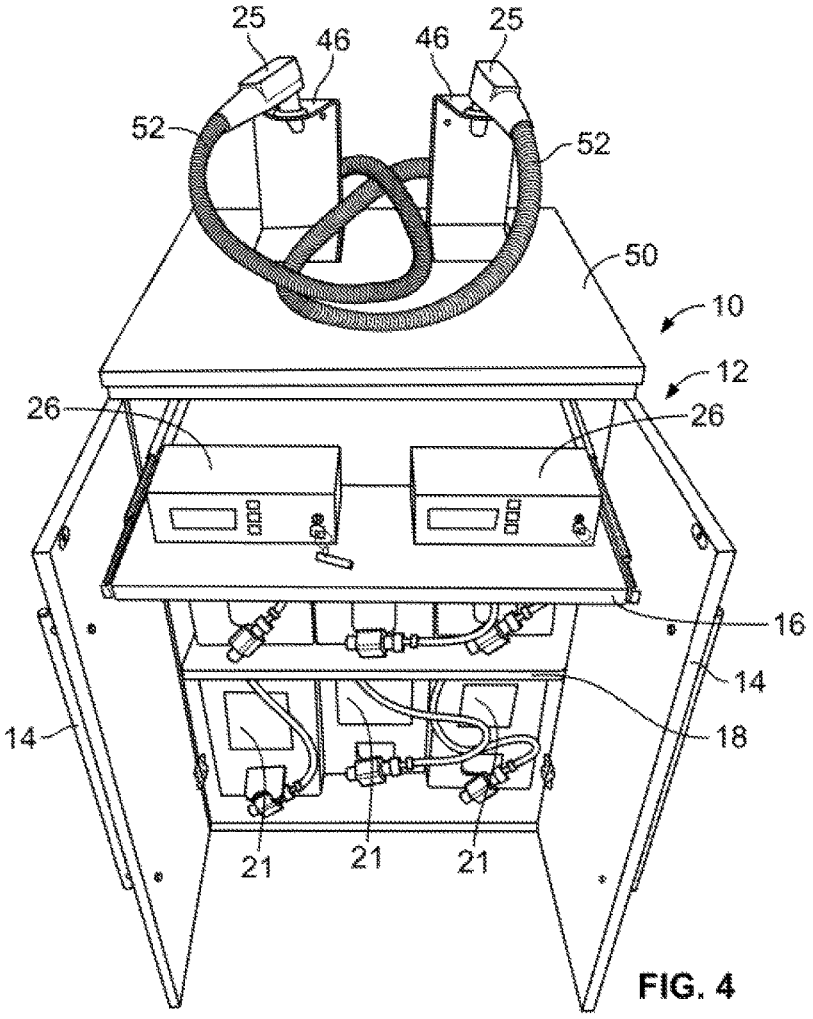
FIG. 4 shows a perspective top view of a dispenser according to the present invention with its cabinet doors open and its first shelf drawn out.
Figure 5:
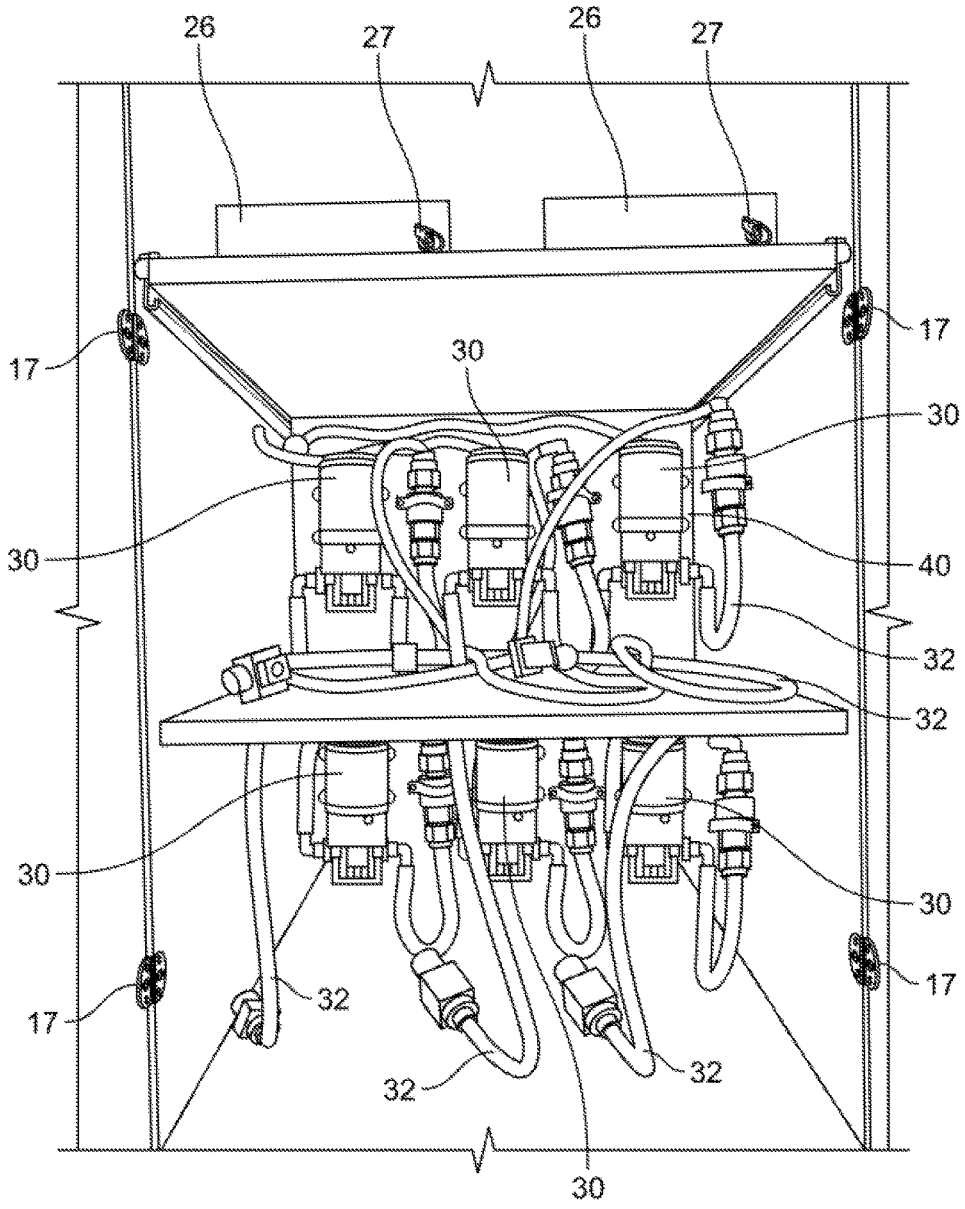
FIG. 5 shows the interior of the cabinet of the dispenser according to the present invention with the spirit boxes removed to show the pumps residing on the back panel of the cabinet and the fluid lines connected to the pumps detached from the spirit boxes.
Figure 6:
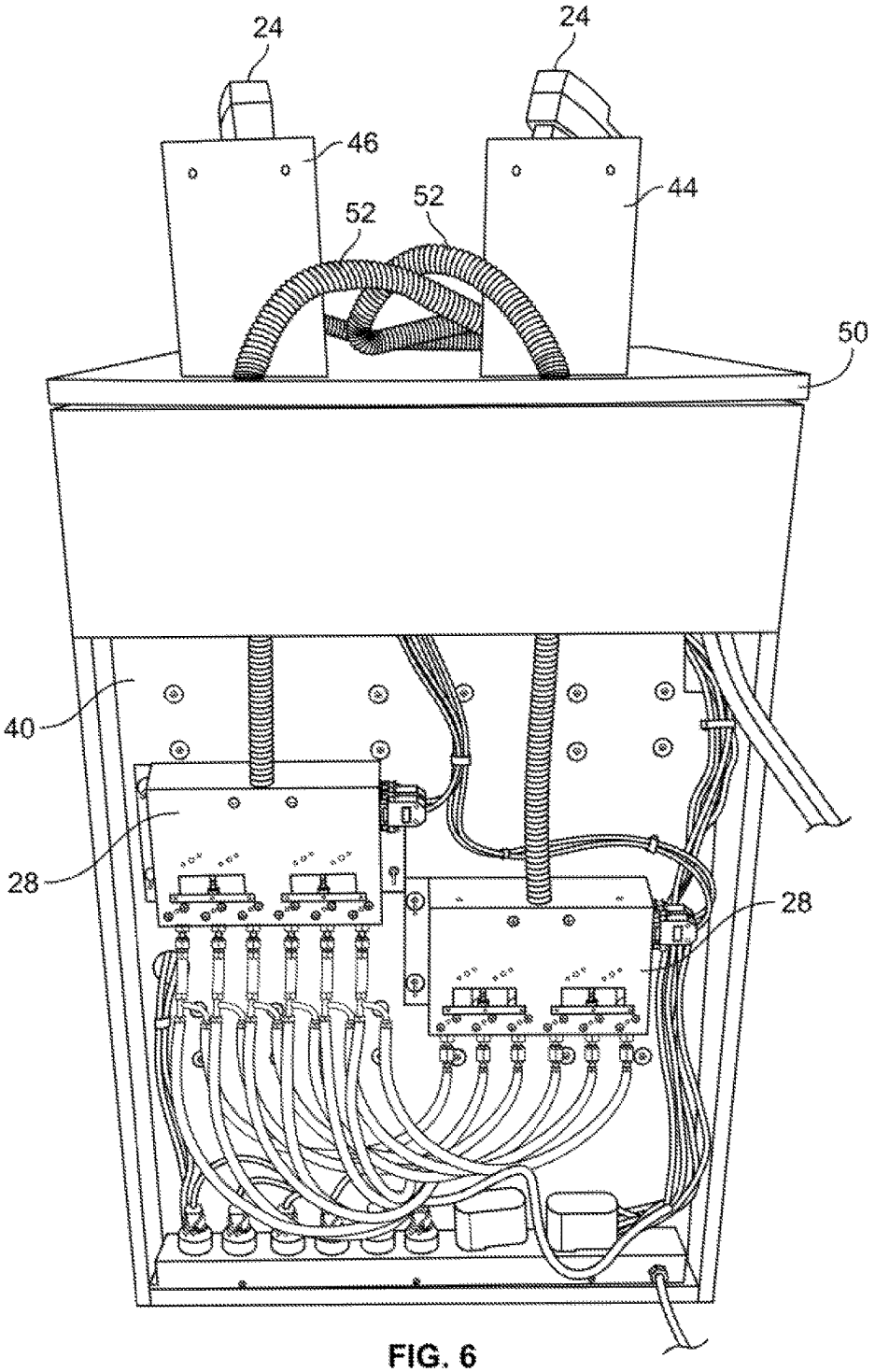
FIG. 6 shows a back view of a dispenser according to the present invention with the dispensing regulators installed on the exterior surface of the back panel and each regulator receiving spirit via a respective tube from a respective pump inside of the cabinet.

Referring to FIG. 4, a first, upper shelf 16 may be slideably arranged inside cabinet 12 to slide in and out of the interior space of cabinet 12.

At least a second shelf 18 may be installed inside cabinet 12. Second shelf 18 may also be slideably arranged to slide into and out of the interior space of cabinet 12.

Second shelf 18 and first shelf 16 define a first compartment 20 (FIG. 2).

Second shelf 18 and base panel 15 of cabinet 12 may define a second compartment 22 (FIG. 2).

According to one aspect of the present invention, a spirit, stored in a container other than a bottle, is stored in either first compartment 20 or second compartment 22. Preferably, the spirit is stored inside of a flexible oxygen-impermeable bag residing in a spirit box 21, which may be a cardboard box with the dimensions 7" wide×12" deep×10" high (standing upright). The bag may be capable of storing at least five liters of spirit resides. Preferably, the bag may be capable of storing up to ten liters of spirit, with nine liters being a preferred volume. The flexible bag may be at least oxygen impermeable, and may also be made of a material that does not permit the spirit to escape if evaporated thereby preventing loss and also preventing odors from escaping. A suitable material may be a metal coated plastic bag or another type of plastic (polymer-based) bag typically used in a bag-in-box products that are used for packaging wine or other beverages, for example.

In the preferred embodiment, each compartment 20, 22 is sized to receive three spirit boxes 21 containing a spirit stored in a bag. Each compartment 20, 22 could store a plurality of spirit boxes 21 (e.g. more than three spirit boxes 21)) side by side. Each spirit box 21 may be storing a different kind of spirit or at least two different kinds of spirits may be stored in cabinet 12 in the various boxes 21. Thus, for example, at least one box 21 could contain whiskey while another box 21 could contain vodka, and yet another box 21 could contain rum.

A portable spirit dispenser 10 according to the present invention further includes at least one portion control fluid dispenser system. The preferred embodiment includes two fluid dispenser systems. Referring to FIGS. 2, 4, 5, and 6, each fluid dispenser system in the preferred embodiment is a digital portion control beverage gun system that includes a beverage gun 24, a portion control unit 26, and a dispensing regulator 28.

In the preferred embodiment, the two digital portion control beverage gun systems may be used to permit service by two service persons, or simultaneous pouring of spirits into two glasses by one service personnel.

Each portion control beverage gun system is in fluid connection with the bags in all boxes 21 stored in cabinet 12. Thus, spirits from all the boxes 21 may be supplied through the two systems. It should be noted that while a portion control system is preferred, a fluid dispenser without portion control may be used as well in another embodiment of the present invention. A suitable dispenser could be the type used for dispensing soft drinks, which allow the operator to control the volume of liquid that is poured (i.e. does not have preset control of the amount of fluid that is poured).

Furthermore, each beverage control system may be provided with a printer as well to provide a hard copy of the data stored in its memory. The printer may be stored on first shelf 16.

The spirit bag in each box 21 may be connected via a respective tube 32 to a respective pump 30. Thus, a pump 30 may be provided for each box 21. Tube 32 may be a flexible, transparent plastic beverage tube with a small diameter (e.g. ⅜") in order to reduce the amount of spirit stored in the fluid delivery line.

Preferably, a self-priming electric (low pressure) diaphragm pump with a built-in ON/OFF switch may be used for a pump 30. If necessary, a transformer may be provided to supply power to each pump 30. Pumps 30 may supply fluid at different pressures. That is, pumps 30 may be a variable pressure pump that can supply spirit at a pressure in the range 15 to 45 Psi, but at least in the range 15 to 20 Psi. Thus, the operator may adjust the supply pressure of each pump as needed. A suitable pump may be a water pump such as a two chamber positive displacement diaphragm pump, which is self-priming, and capable of being run dry. It has been found that a 24V diaphragm water pump with a variable regulator that is sold by SeaFlow works well. A description of the SeaFlow pump is included in the Appendix of U.S. 62/279,196, which is incorporated by reference. A single transformer may be used to convert the line voltage (110V or 220V) to a suitable voltage and supply power to all pumps at the suitable voltage. If needed, the transformer may convert the AC line power to DC. The transformer may be located inside or outside of the cabinet.

Figure 7:
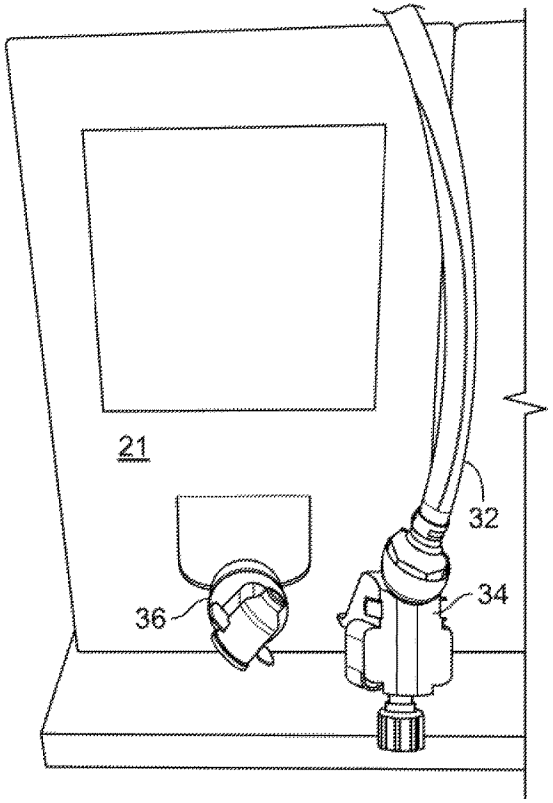
FIG. 7 shows a spirit box with a tap connected to the spirit bag therein detached from a tap connector that is connected to a fluid line connected to a pump.

Referring to FIG. 7, each spirit bag preferably includes a tap 36. The spirit contained in the bag is accessed via tap 36 of the spirit bag. A tap connector 34 may be used to connect to tap 36 of box 21. Each tap connector 34 is disengageable from the tap to which it is connected to permit removal of an empty box. The disengaged tap connector 34 can then engage the tap of another box. The tap 36 used may be any conventional tap used, for example, in bag-in-box products which have wine therein. The tap connector 34 may be any suitable connector that can selectively engage and disengage from a tap 36 in order to permit the functions described herein.

Preferably, each pump 30 is arranged (connected or attached) on a back panel 40 of cabinet 12 behind a box 21 inside of cabinet 12.

Tube 32 is preferably at least long enough to reach a pump 30 located behind a box 21 from the front of box 21. Thus, advantageously, a box 21 may be disconnected from a tube 32 and removed from cabinet 21 without reaching behind box 21, or sliding out the shelf to access its tap 36.

Portion control unit 26 of each portion control system is disposed on first shelf 16. Each portion control unit 26 includes at least a microcontroller and an electronic memory to store data.

Preferably, each portion control unit 26 can be locked with a lock 27 and rendered inoperative as an extra measure against pilfering or theft.

Figure 8:
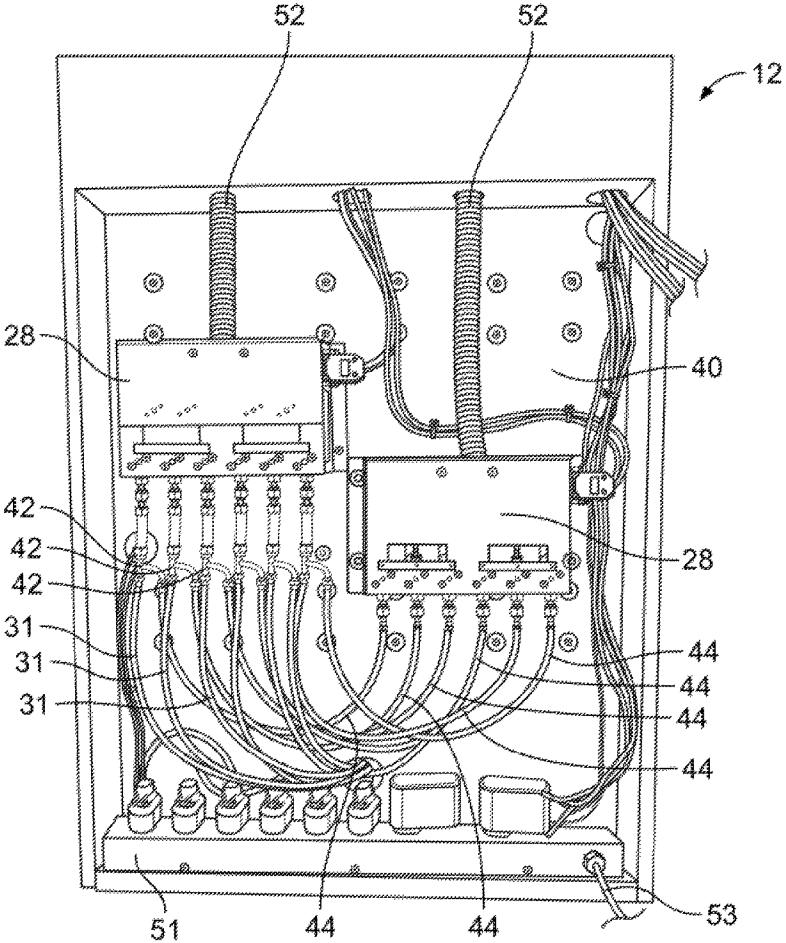
FIG. 8 shows another view of the back of the cabinet of the dispenser according to the present invention in which each spirit regulator is connected to a dispenser/beverage gun with a respective tube to dispense spirit from the spirit bags inside of the cabinet to the gun under the control of a portion control unit residing inside of the cabinet of a dispenser system according to the present invention.

Referring to FIG. 8, each dispensing regulator 28 is connected to a respective portion control unit 26. Each dispensing regulator 28 may be attached to the exterior surface of the back panel 40 of cabinet 12. Each regulator 28 may be 9" wide×3" high×6" deep. Advantageously, a compact configuration is realized for pumps 30 as well as the components of the portion control system, whereby the footprint of the dispenser is kept small, which is important for portability, storage and so on.

A supply tube 31 is connected from each pump 30 to a dispensing regulator 28. Each supply tube 31 passes through a passage defined in the back panel of cabinet 12 (the panel directly facing the doors) to the exterior surface thereof where regulators 28 are installed. The passage is preferably defined below the location of regulators 28. When a second portion control system is used, as is the case in the preferred embodiment, a splitter 42 may be used to split the supply line 31 from a pump 30 and to provide spirit to the other dispensing regulator 28 via a respective tube 44. Tube 31 may be a flexible, transparent, plastic beverage tube with a small diameter (e.g. ⅜") to minimize the amount of spirit stored therein.

A main spirit supply tube 52 supplies spirit from a dispensing regulator 28 to a beverage gun 24. The amount of spirit supplied from beverage gun 24 is controlled by portion control unit 26. That is, unit 26 controls regulator 28 in order to limit the amount of spirit supplied by the gun to a specified amount, which may be stored in the memory of unit 26 and changed as needed.

Figure 9:
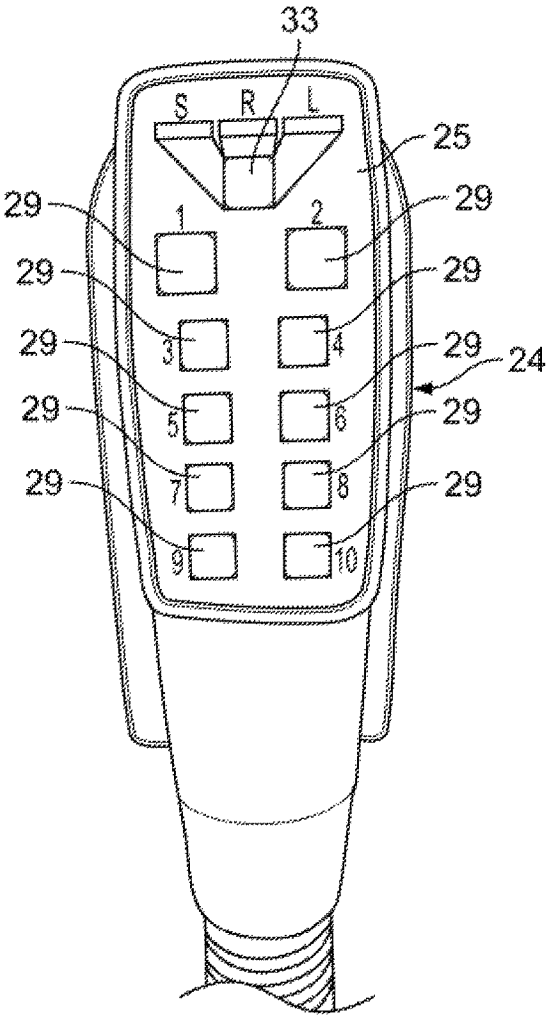
FIG. 9 shows a selection interface for a dispenser gun of a portion control system used in a dispenser according to the present invention.

Beverage gun 24 includes an interface 25. FIG. 9 shows a typical selection interface 25 for the gun 24 part of the portion control fluid dispenser system. Interface 25 may include ten spirit selection buttons 29. Each spirit selection button 29 permits the operator to select a type of spirit that is stored in the boxes 21 stored in the dispenser 10. Also, interface 25 includes a portion selection button 33. Portion selection button 33 permits the operator to select a preset portion from among, for example, three preset portions. The preset portions may be one shot (one fluid ounce), and more than one shot of spirit.

Figure 10:
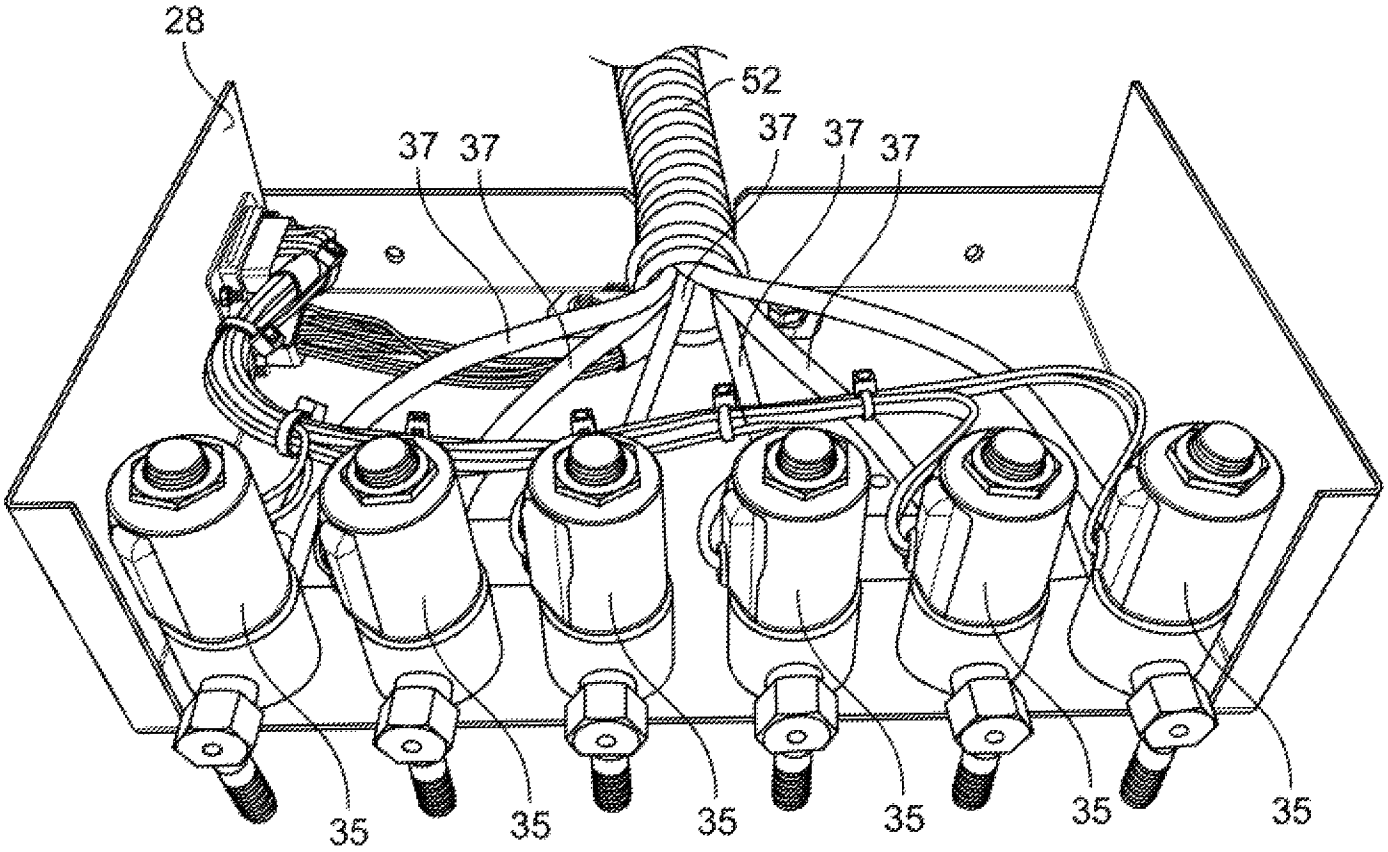
FIG. 10 shows the interior of a regulator of a portion control system used in a dispenser according to the present invention.

Referring to FIG. 10, regulator 28 may include a plurality of solenoids 35. Each solenoid 35 is connected to a respective supply tube 31 at its input. At its output, each solenoid is connected to a respective gun supply tube 37. All gun supply tubes 37 are received in tube 52 and connected to gun 24. Each gun supply tube 37 may be a flexible, transparent and plastic beverage tube with an inner diameter of ⅜". FIG. 10 also shows the control and power cables for operating each solenoid 35. Based on the instruction received from interface 25, a portion control unit 26 controls the amount of spirit supplied by an associated (controlled) dispensing regulator 28 by controlling regulator 28.

It should be noted that a manager, for example, could set the amount that is to be poured, and because the cabinet can be locked, this amount cannot be changed by the service personnel.

Alternatively, interface 25 could allow the operator to set the amount of spirit that is supplied.

A printer may be connected to unit 26 to print every shot that is poured.

Alternatively, or in addition, a computer (e.g. a PC or a tablet) could be connected to unit 26 to record every shot.

Spirit dispenser 10 may further include a beverage gun cradle 46 to support beverage gun 24 atop cabinet 12. A countertop 50 may also be disposed atop cabinet 12 for decorative purposes.

Countertop 12 may include an opening therein to receive the base of a gun cradle 46. When two cradles 46 are provided, two openings may be defined in the countertop 50 or a large opening to accommodate two gun cradles.

Preferably, countertop 50 is not attached to cabinet 12, whereby it can be removed to permit cabinet 12 to be installed under an existing countertop, for example, at a bar. Thus, for example, a dispenser 10 according to the present invention may be no taller than 36.5 inches, which is a conventional counter top height.

Furthermore, it is preferred that the footprint of a dispenser according to the present invention will be kept to 24"×24", which is a standard under counter equipment footprint, and convenient for storage under an existing counter.

Preferably, in a dispenser 10 according to the present invention, all electrical devices receive electrical power from a single power line that is pluggable into a wall outlet. Thus, as seen in FIG. 8, a power strip 51 or the like may be used to distribute power to all electrical components (six outlets for the six pumps and two outlets to supply power to the portion control fluid dispenser systems) of dispenser 10 from a single power line 53. The electrical devices are selected so that, in operation, the current drawn will not cause the breaker to trip open. Thus, for example, the maximum current drawn will be below 15 Amps, and preferably below 10 Amps. In the preferred embodiment, all electrical components are selected to draw about 7.2 Amps. This feature also ensures that dispenser 10 is portable from one location to another location as it would not require a special electrical outlet since dispenser 10 could be operated from any location with an outlet that includes a 10 Amp breaker.

In use, several different spirit types may be dispensed from a spirit dispenser 10 according to the present invention. Thus, in a method according to the present invention, spirit or liquor is provided in a bag residing in a box 21 as previously described, and a portable dispenser as described is used to dispense the spirits of different kinds from the bags, thereby alleviating the problems associated with the conventional automated liquor dispensers, which are not portable and suffer from other drawbacks.

A suitable portion control fluid dispenser system for integration in a dispenser 10 is a portion control liquor and soda dispenser sold by Griffin Industries under the Model No. GCS/9210, a description of which is included in the Appendix. The system allows for serving up to ten flavors or liquor and up to three different portion sizes.

It should be noted that the distance between the tap of each spirit box and the gun may be ten feet or less. Given that the tubes 31, 32, 37 may have small inner diameters, compared to the known systems described in the background, very little spirit is stored in the fluid lines, which means that servicing will not result in as much loss of product. Thus, by keeping the distance between a spirit box and the dispenser gun to 10 feet or less no more than 8 fluid ounces (7.6 Oz or 225 ml) of spirit will be stored in each line when ⅜" diameter tubes are used. As a result, only about eight shots of spirit is lost when a line is emptied for disinfection and servicing.

Figure 11:
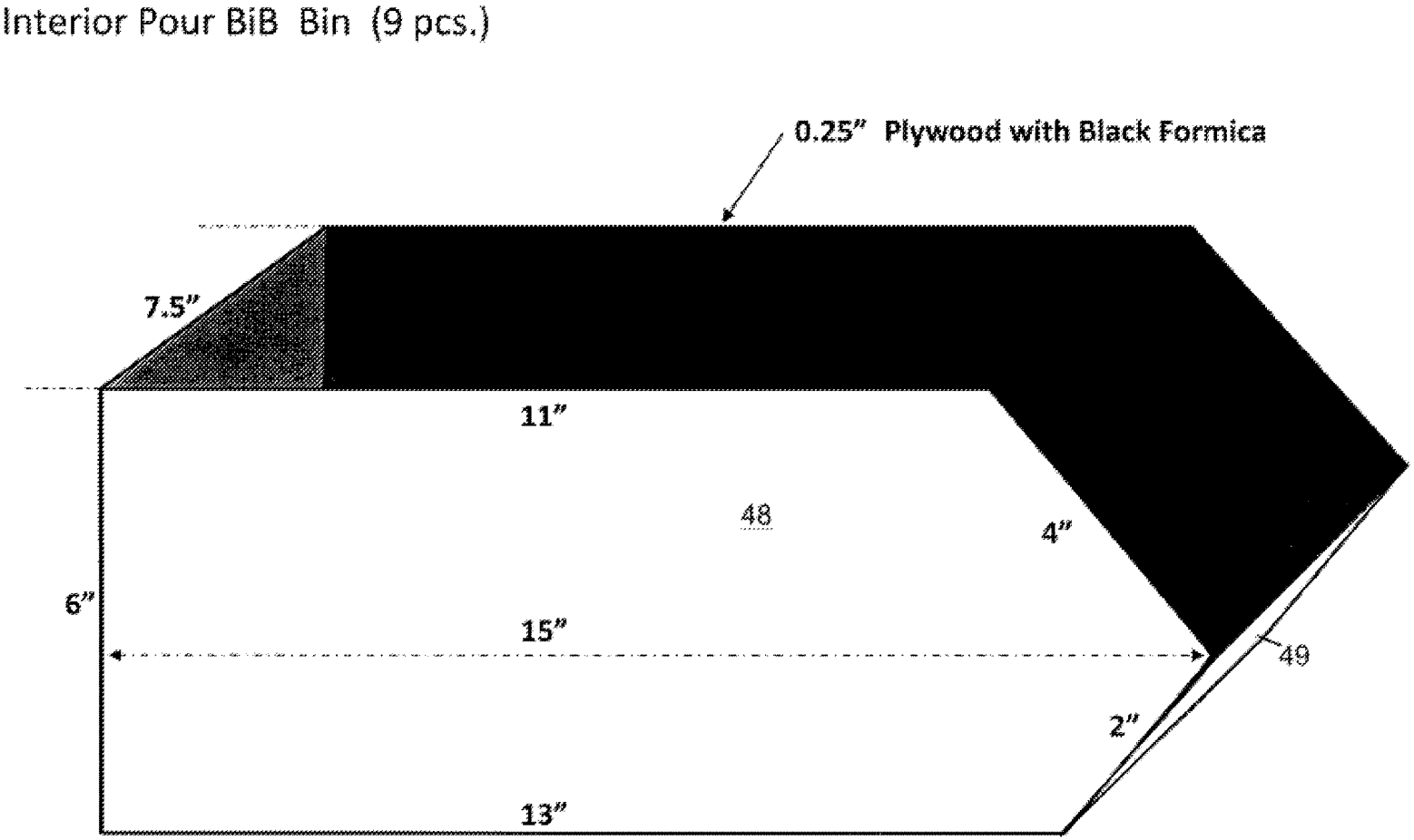
FIG. 11 illustrates a bin for use in a second configuration of a spirit dispenser according to the present invention.

It is also possible to increase the amount of spirit served from a spirit dispenser according to the present invention without increasing the foot print of the cabinet 12. To do so, the bag containing spirit is removed from its box and stored in a bin. An example, of such a bin 48 is shown in FIG. 11. A suitable bin 48 has an open top and a partially open front to permit access to the tap part of the removed bag. The partially open front may include a bottom wall 49 that only partially closes the front part of bin 48. The bottom wall 49 at the front of bin 48 may extend forwardly and upwardly at an angle other than ninety degrees (preferably 45 degrees). The preferred dimension (in inches) for bin 48 are indicated in FIG. 11.

Figure 12A:
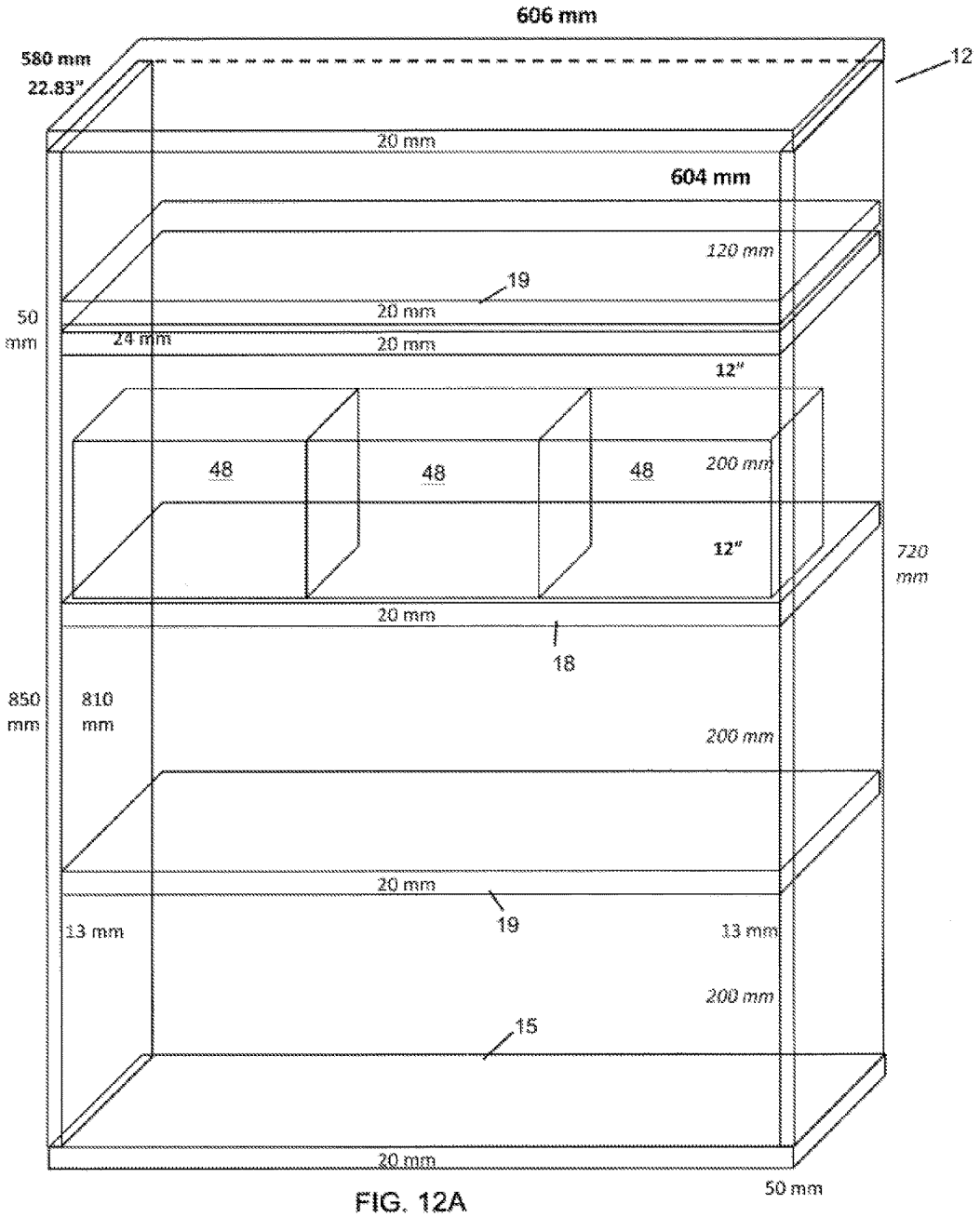
FIGS. 12A-12D show respectively a perspective view of a cabinet for the second configuration, a disassembled view thereof without interior parts, a front elevation thereof, and a side elevation thereof.
Figure 12B:
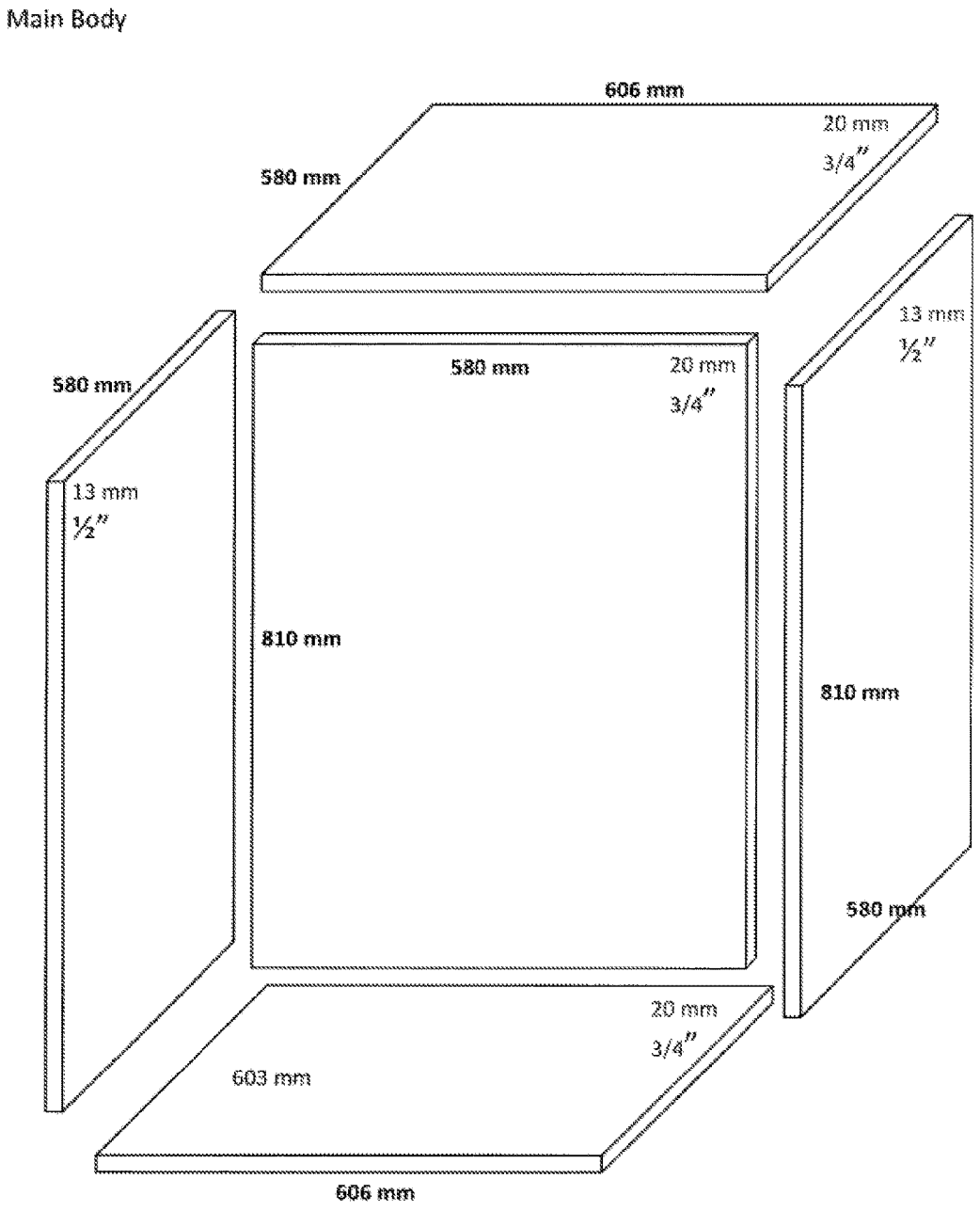
Figure 12C:
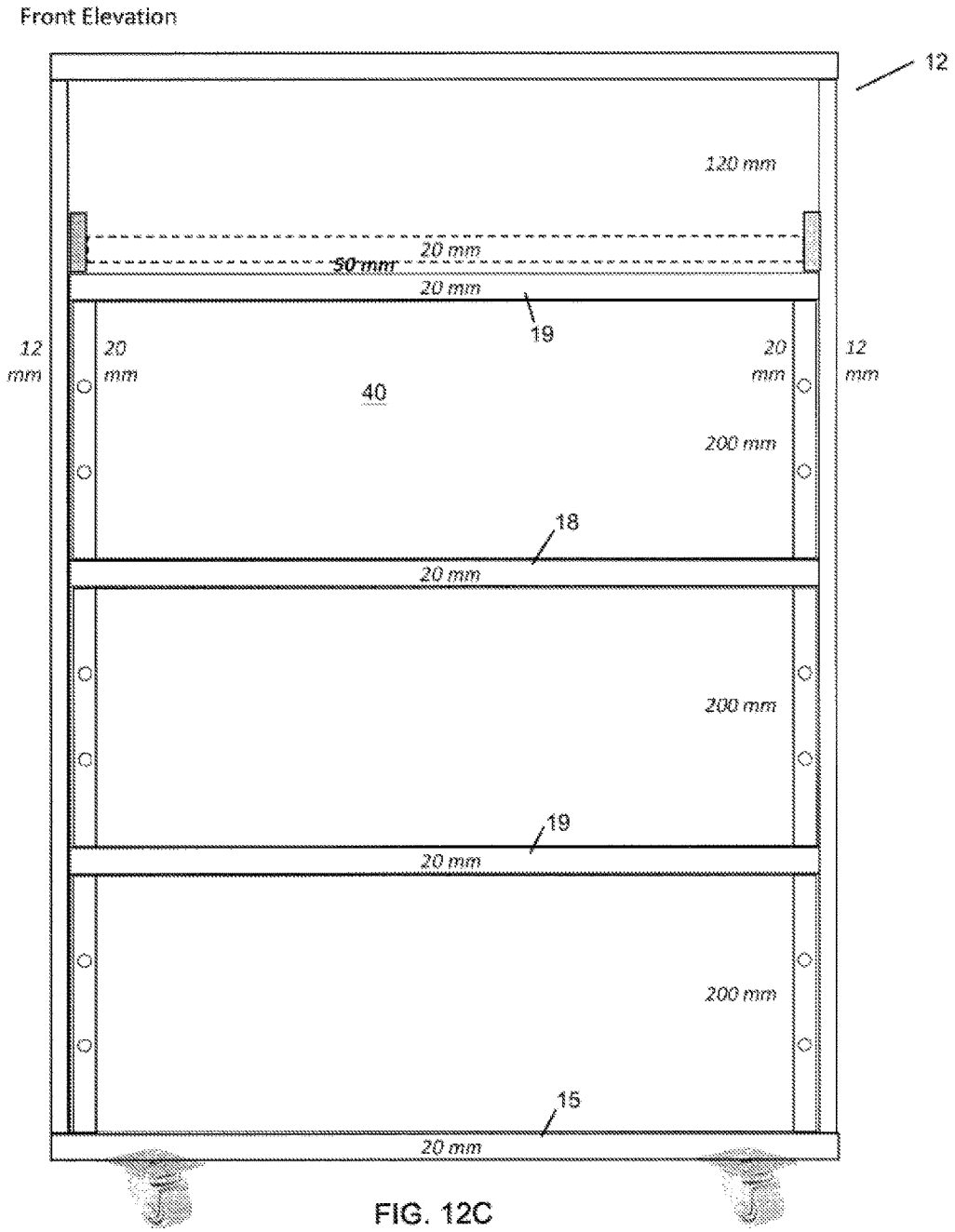
Figure 12D:
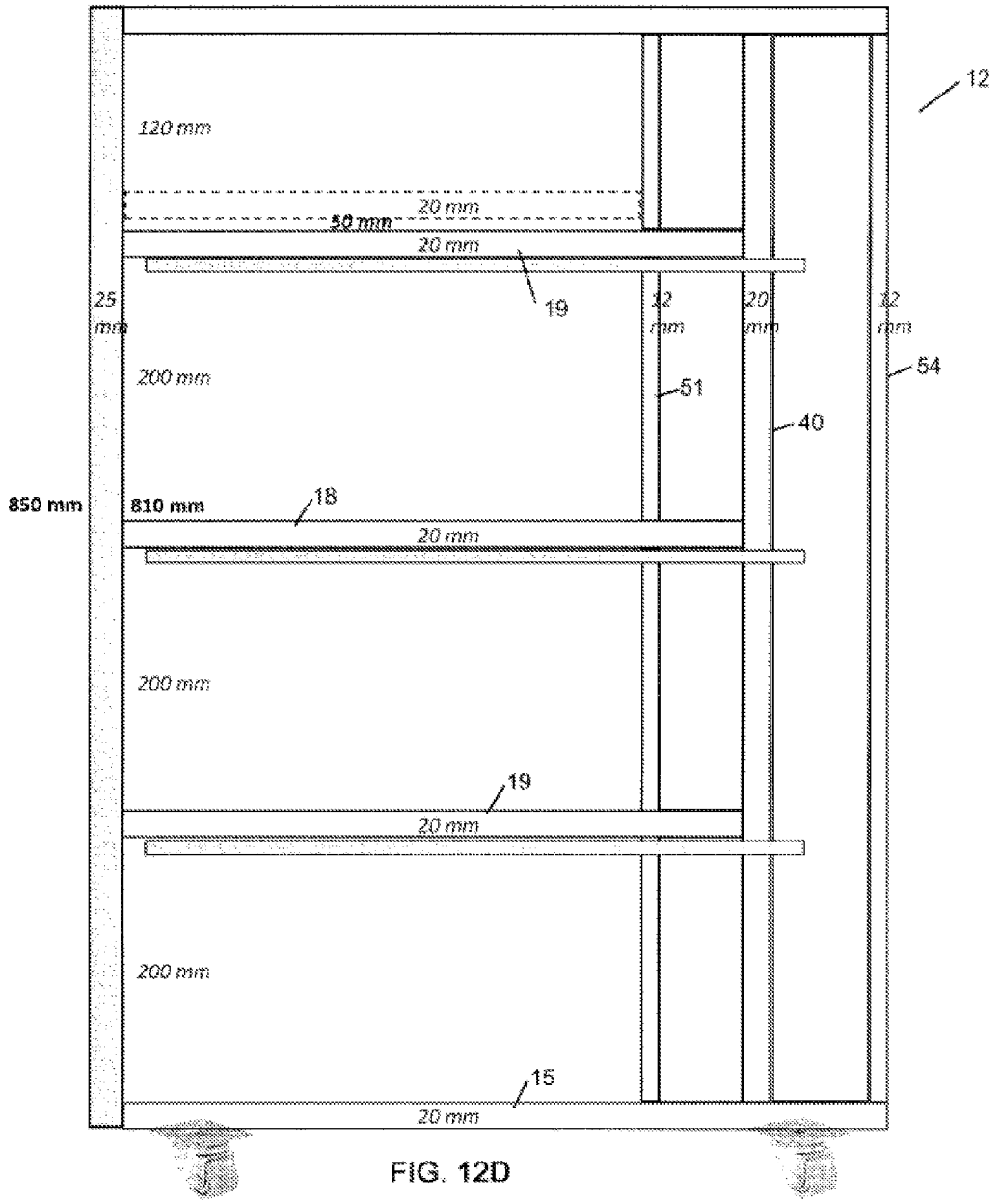

By removing the box and using bins, more space is available in cabinet 12. Thus, for example, three bins 48 may fit side-by-side on a shelf inside of cabinet 12 as shown in FIG. 12A. Furthermore, the height of each bin 48 permits installation of another shelf 19 inside of cabinet 12. Consequently, nine bins 48 can be stored inside cabinet 12 and thus nine spirit bags thereby allowing for storage and service of more varieties of spirit from a dispenser according to the present invention without increasing its interior volume or footprint.

Figure 12E:
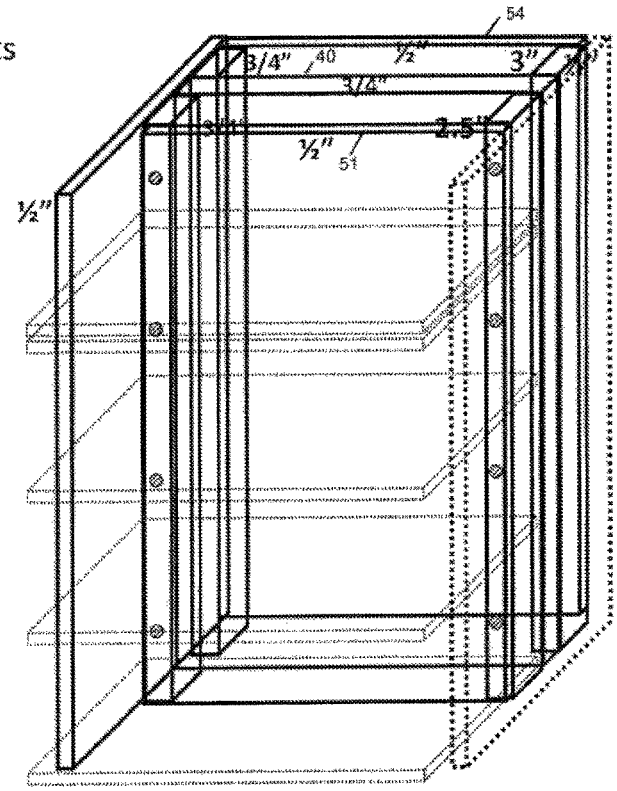
FIG. 12E shows another perspective view of a cabinet according to the second configuration with certain parts removed from view to illustrate the interior and the exterior protection panels.

Referring to FIG. 12E, an interior protection panel 51 may be installed inside cabinet 12 to prevent access to the pumps 30, thereby reducing chances of accidental damage or tampering. An exterior protection panel 54 may also be provided opposite the back panel of cabinet 12 to prevent access to the regulators 28, tubes 44, 52, thereby reducing chances of accidental damage or tampering.

Figure 13D:
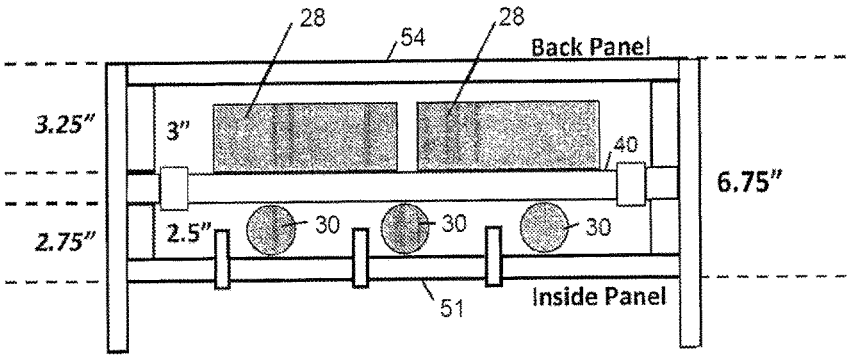
FIGS. 13A-13D illustrate a cabinet according to the second configuration with the pumps installed therein.
Figure 13A:
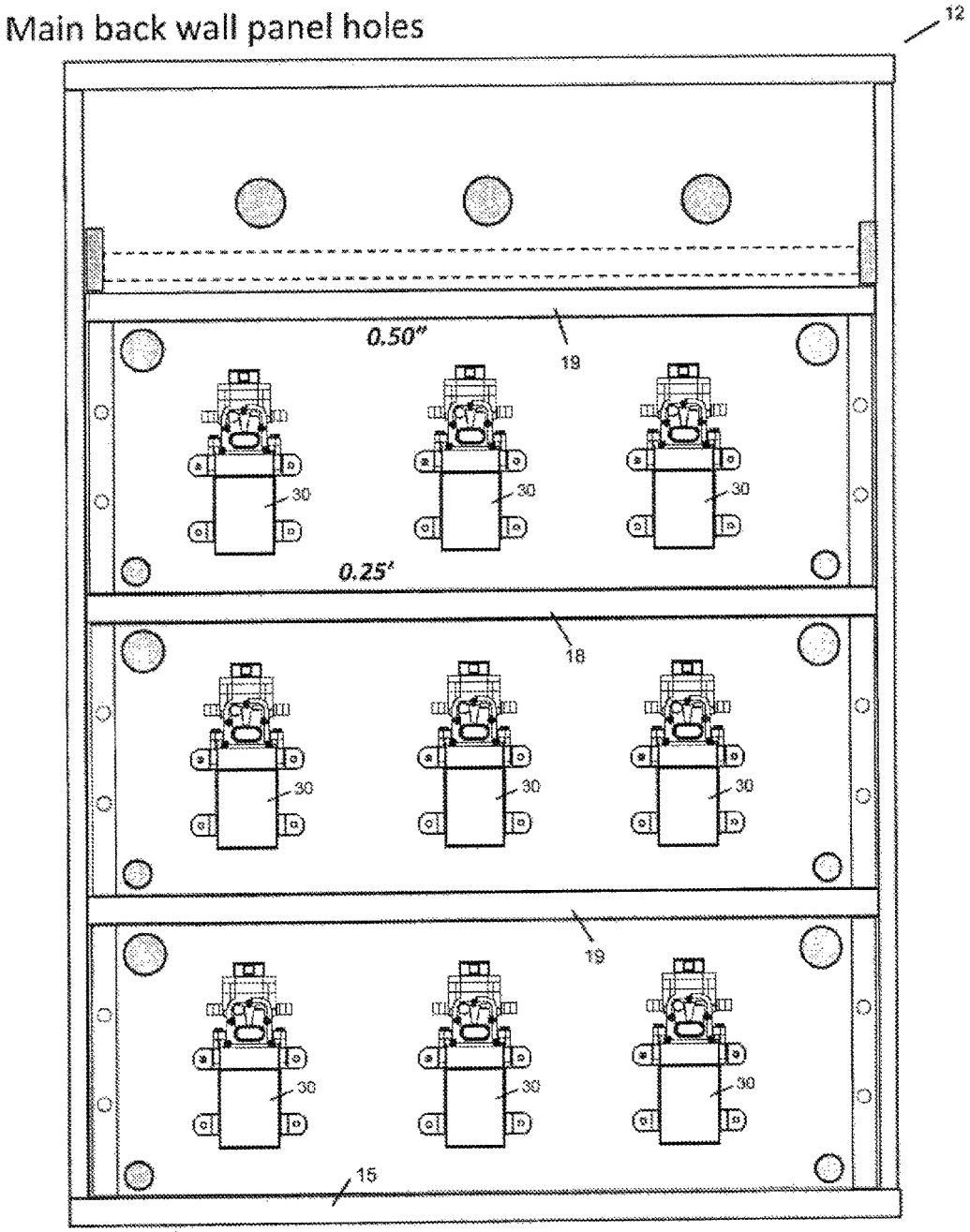
Figure 13B:
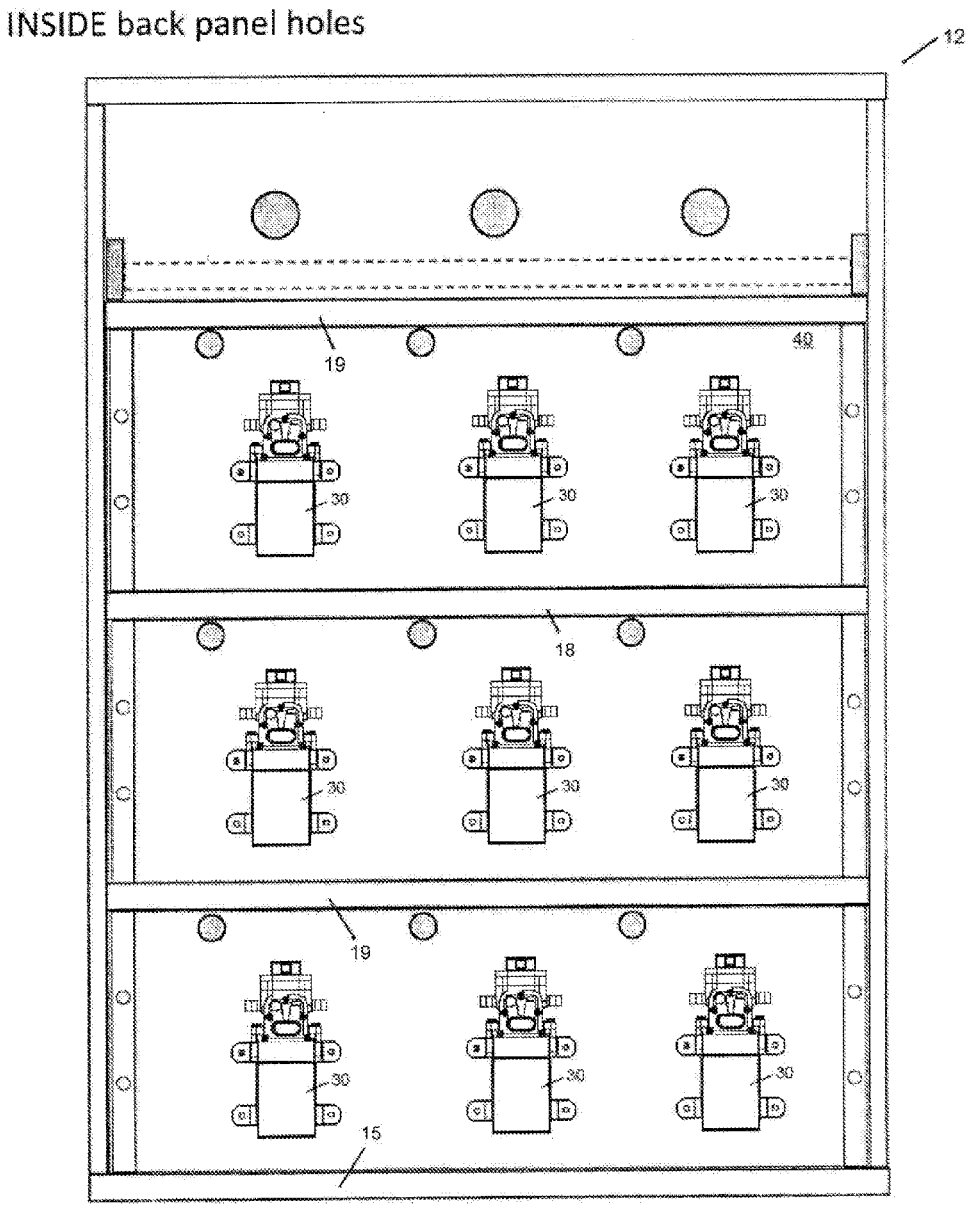
Figure 13C:
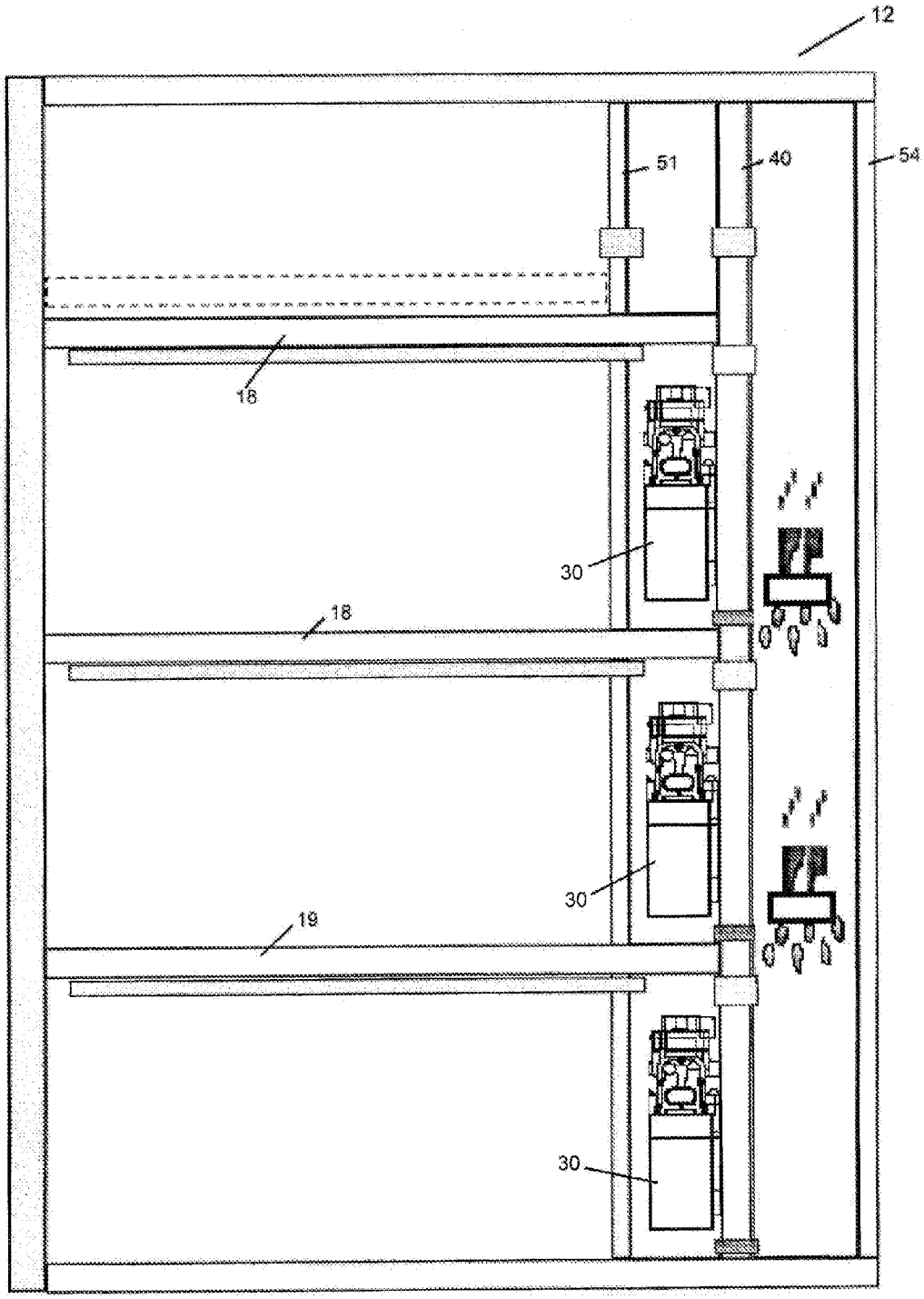
Figure 15:
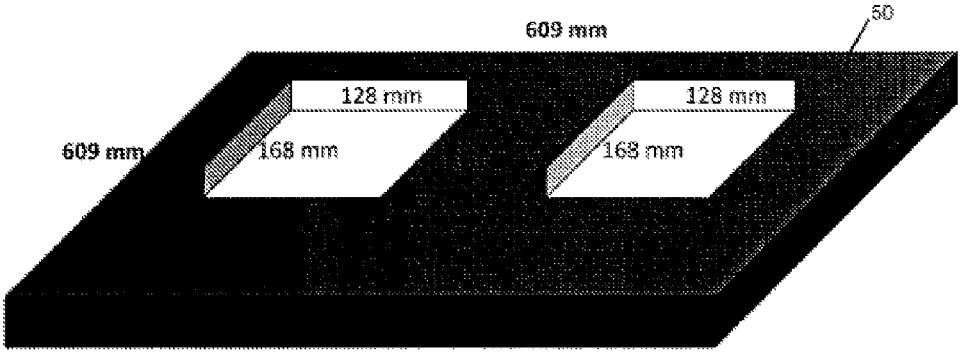
FIG. 15 shows a countertop that can be placed atop of a cabinet for a dispenser according to the present invention, the counter top including recesses to receive the cradles for the guns.
Figure 16:
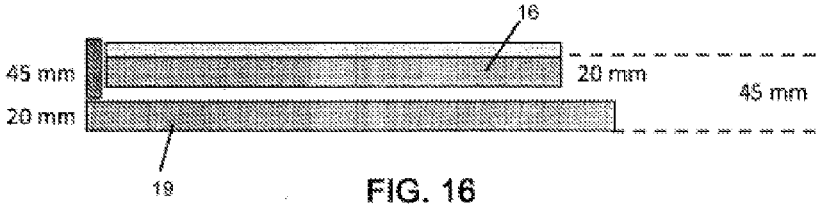
FIG. 16 illustrates the arrangement of the top shelf above an additional shelf inside of a cabinet according to the second configuration.

Referring to FIG. 13A-C, a pump 30 may be installed on the interior surface of the back panel of cabinet 12 behind each bin 48 residing on a shelf or the bottom of cabinet 12. This figure also shows holes in the back panel for the tubes from the pumps to the regulators 28 and the power lines for powering the pumps 30.

FIGS. 11-16 demonstrate a cabinet 12 that is configured to accommodate nine bins 48. These figures show dimensions for the cabinet 12 and the bins 48 to demonstrate the compactness of the design. Thus, as shown, a cabinet with a conventional footprint of 24" inches by 24", and a conventional height for under-the-counter storage, may be configured to store nine spirit bags.

Although not shown, it should be understood that the remaining features of a spirit dispenser according to the invention will be integrated with the cabinet as described here except that the system will be configured to serve spirit from nine bags not six.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A spirit dispenser comprising:

a cabinet that includes a back panel facing an interior of the cabinet, and a first compartment and a second compartment defined by a shelf, the second compartment being below the first compartment, each compartment being adjacent an interior surface of the back panel, and each compartment being able to receive therein a plurality of spirit containers;

at least one spirit dispenser system integrated with the cabinet; and a first group of pumps adjacent the first compartment residing on the interior surface of the back panel, and a second group of pumps adjacent the second compartment and residing on the interior surface of the back panel of the cabinet below the first group of pumps, each pump being connected to a respective first tube that includes a respective tap connector configured for connection to a tap of a respective spirit container residing in either the first compartment or the second compartment, and each pump being connected to a respective second tube that is connected to the spirit dispenser;

wherein each pump is positioned to be directly behind a respective spirit container to which it is to be connected via its associated first tube;

wherein the spirit dispenser includes a dispensing regulator and a spirit gun;

wherein the second tubes are connected to the dispensing regulator, and the dispensing regulator is connected to the spirit gun via a third tube; and wherein the dispensing regulator resides on an exterior surface of the back panel opposite the interior surface of the back panel and outside of the cabinet.

2. The spirit dispenser of claim 1, wherein the spirit dispenser is a portion control fluid dispenser system.

3. The spirit dispenser of claim 2, wherein the portion control fluid dispenser system includes a digital portion control unit, and the dispensing regulator is controlled by the portion control unit.

4. The spirit dispenser of claim 3, further comprising at least another spirit dispenser system, wherein the another spirit dispenser system is a digital portion control fluid dispenser system having a respective portion control unit, and a respective dispensing regulator controlled by its respective portion control unit, wherein each second tube is connected to one of the two dispensing regulators and connected to the other one of the two dispensing regulators via a splitter and a fourth tube.

5. The spirit dispenser of claim 4, further comprising at least one printer residing in the cabinet and connected to at least one of the spirit dispenser systems.

6. The spirit dispenser of claim 5, wherein the spirit containers are boxes, each box containing a bag in which spirit is stored, wherein the cabinet can store therein six containers, and the cabinet has a foot print of twenty four inches by twenty four inches.

7. The spirit dispenser of claim 5, wherein the spirit containers are bags containing spirit each residing in a respective bin, wherein the cabinet is configured to store nine bins, and has a foot print of twenty four inches by twenty four inches.

8. The spirit dispenser of claim 7, wherein each bag contains at least ten liters of spirit.

9. The spirit dispenser of claim 1, wherein each pump is a self-priming electric pump.

10. The spirit dispenser of claim 9, wherein each pump is a variable pressure pump operable in the range 15-45 Psi.

11. The spirit dispenser of claim 1, wherein the dispenser is electrically operable and draws no more than 15 Amps when operating.

12. The spirit dispenser of claim 11, wherein the cabinet includes a plurality of casters capable of supporting at least 800 pounds.

13. The spirit dispenser of claim 1, wherein no more than eight fluid ounces is stored in the line between the spirit dispenser and the spirit container.

14. A method of serving spirit with a spirit dispenser according to claim 1, comprising receiving a spirit product that comprises a container, the container including a box, a bag residing in the box, a tap connected to the bag, and spirit stored in the bag, and connecting the tap connector of the first tube to the tap.

* * * * *